US009130294B2

(12) United States Patent
Schmatz et al.

(10) Patent No.: US 9,130,294 B2
(45) Date of Patent: Sep. 8, 2015

(54) LATCHABLE CONTACT HAVING A PRIMARY LOCKING LANCE OVERLAPPED BY A SIDE WALL

(71) Applicants: Ulrich Schmatz, Besigheim (DE); Rolf Wittmann, Ludwigsburg (DE)

(72) Inventors: Ulrich Schmatz, Besigheim (DE); Rolf Wittmann, Ludwigsburg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 53 days.

(21) Appl. No.: 14/043,475

(22) Filed: Oct. 1, 2013

(65) Prior Publication Data

US 2014/0099841 A1 Apr. 10, 2014

(30) Foreign Application Priority Data

Oct. 5, 2012 (DE) ..... 10 2012 218 234

(51) Int. Cl.
*H01R 13/432* (2006.01)

(52) U.S. Cl.
CPC ..... *H01R 13/432* (2013.01)

(58) Field of Classification Search
USPC ..... 439/872, 748, 736, 353, 354, 595, 752
See application file for complete search history.

(56) References Cited

U.S. PATENT DOCUMENTS

| | | | | | |
|---|---|---|---|---|---|
| 4,306,761 | A * | 12/1981 | Ress, Jr. | ..... | 439/862 |
| 4,781,628 | A * | 11/1988 | Detter et al. | ..... | 439/748 |
| 5,462,457 | A * | 10/1995 | Schroepfer et al. | ..... | 439/736 |
| 5,672,071 | A * | 9/1997 | Ceru | ..... | 439/353 |
| 5,695,368 | A * | 12/1997 | Joly et al. | ..... | 439/748 |
| 6,106,339 | A * | 8/2000 | Nagai | ..... | 439/748 |
| 6,254,418 | B1 * | 7/2001 | Tharp et al. | ..... | 439/352 |
| 6,267,616 | B1 * | 7/2001 | Sakatani et al. | ..... | 439/397 |
| 6,435,896 | B1 * | 8/2002 | Takatsuki | ..... | 439/354 |
| 6,796,845 | B2 * | 9/2004 | Kuiken et al. | ..... | 439/668 |
| 7,217,161 | B1 * | 5/2007 | Tyler et al. | ..... | 439/748 |
| 8,777,677 | B2 * | 7/2014 | Pade et al. | ..... | 439/748 |

FOREIGN PATENT DOCUMENTS

DE 10 2009 054705 6/2011

* cited by examiner

*Primary Examiner* — Alexander Gilman
(74) *Attorney, Agent, or Firm* — Kenyon & Kenyon LLP

(57) ABSTRACT

A contact is provided for latching in a contact chamber of a plug connection element. The contact has a contact box having an upper wall, a lower wall, and two opposing side walls. A primary locking lance protrudes resiliently diagonally outward from the upper wall. To protect the primary locking lance against harmful plastic deformations due to externally attacking forces, at least one of the side walls, in an area laterally adjoining the primary locking lance, is configured to protrude outward beyond a plane of the upper wall. An outside edge is bent toward the primary locking lance, so that it overlaps a side edge of the primary locking lance so that it counteracts outward bending of the primary locking lance in a form-locked manner.

11 Claims, 4 Drawing Sheets

LATCHABLE CONTACT HAVING A PRIMARY LOCKING LANCE OVERLAPPED BY A SIDE WALL

RELATED APPLICATION INFORMATION

The present application claims priority to and the benefit of German patent application no. 10 2012 218 234.9, which was filed in Germany on Oct. 5, 2012, the disclosure of which is incorporated herein by reference.

FIELD OF THE INVENTION

The present invention relates to a contact, which is provided for latching in a contact chamber of a plug connection element. Furthermore, the present invention relates to a plug connection element having such a contact.

BACKGROUND INFORMATION

In particular for automobile applications, plug connection elements are frequently used, in which multiple contacts are each inserted into a contact chamber of a plug, which is configured as a plug connection element, or a bush and fixed therein. The plug connection element is used as a contact carrier.

On each of the contacts, which are provided in a front area with a cuboid contact box, for example, which is designed for contacting a matching counter contact, first an electrical line in the form of a cable is fastened, for example, by crimping onto a rear end of the contact, for example. Subsequently, the contact is inserted into one of the contact chambers of the plug connection element.

A so-called primary locking lance provided on the contact may be used for the purpose of latching the contact in the contact chamber. The primary locking lance protrudes outward from the contact box in this case and may be displaced resiliently toward the contact box. During the insertion of the contact into the contact chamber, the primary locking lance first compresses until a suitable recess in the contact chamber is reached, in which the primary locking lance then decompresses and thus latches the contact within the contact chamber in a form-locked manner.

A conventional electrical contact, which is provided with a protruding primary locking lance, for plug connections is described in DE 10 2009 054 705 A1.

A primary locking lance, which protrudes outward and which may be freestanding, is at risk, however, of being damaged by externally acting forces. For example, forces acting from above, below, or laterally on the primary locking lance may act during the manufacturing and during the handling of the contact and may plastically deform and damage the primary locking lance. Strong forces may also be exerted on the primary locking lance in a state latched in a contact chamber, for example, in the event of tension on a cable crimped onto the contact, whereby the primary locking lance latched in the contact chamber may be deformed excessively outward and damaged in the process.

SUMMARY OF THE INVENTION

Specific embodiments of the present invention allow the primary locking lance of a contact to be substantially protected against damage due to excess plastic deformation.

According to one aspect of the present invention, a contact which is provided for latching in a contact chamber of a plug connection element has a contact box and a primary locking lance. The contact box has an upper wall, a lower wall, and two diametrically opposing side walls and may therefore be designed to be cuboid, for example. The primary locking lance protrudes resiliently diagonally outward from the upper wall of the contact box. The contact is distinguished in that at least one of the side walls of the contact box, in an area laterally adjoining the primary locking lance, protrudes outward, i.e., upward, beyond a plane of the upper wall of the contact box, an outside edge of this side wall overlapping a side edge of the primary locking lance in such a way that it counteracts outward bending of the primary locking lance in a form-locked manner.

In other words, the primary locking lance of the contact may be protected against damage by excess outward bending in that at least one of the side walls of the box does not only delimit one side of the contact box, but rather it is also embodied as protruding upward beyond a plane of the upper wall and therefore also laterally adjoining the primary locking lance, which also protrudes upward. In this way, the primary locking lance may already be protected against forces acting laterally thereon. In addition, the outwardly protruding side wall is to be bent on its outside, i.e., upper edge toward the primary locking lance in such a way that it overlaps same at its side wall. Due to this lateral overlap, a form-locked connection may be achieved between the side wall and the primary locking lance, which prevents the primary locking lance from being bent excessively outward, i.e., away from the upper wall of the contact box.

Not only one but rather both side walls of the contact box may be embodied in such a way that, in an area laterally adjoining the primary locking lance, they protrude outward beyond a plane of the upper wall, outside edges of both side walls each overlapping one of the side edges of the primary locking lance in such a way that they counteract outward bending of the primary locking lance in a form-locked manner. In this way, the primary locking lance may be laterally protected against forces attacking from both sides. In addition, the primary locking lance, in the event of an outwardly directed force acting thereon, may be held on both opposing side edges by the two overlapping side walls, whereby twisting of the primary locking lance may also be prevented.

The outside edge of an outwardly protruding side wall is to be bent in such a way that it overlaps a side edge of the primary locking lance, but a central area of the primary locking lance is not to be overlapped by the side wall, in particular at an area protruding farthest over the upper wall of the contact box. In other words, the side wall, which at least partially overlaps the primary locking lance in a form-locked manner, is to expose at least the area of the primary locking lance protruding farthest over the upper wall. In this way, the primary locking lance, which in contrast to the side wall may be deflected downward elastically resiliently toward the contact box, may be pressed downward on its area protruding farthest above the upper wall, for example, during the insertion into a contact chamber. The primary locking lance may be pressed downward on its exposed central area by an appropriately designed counter surface in the contact chamber, for example, the side walls laterally overlapping the side edge of the central area so as not to obstruct such pressing downward.

The overlapping outside edge of the side wall may extend along the entire length of the outwardly protruding primary locking lance. In this way, the primary locking lance is protected along its entire length with respect to both laterally acting forces and with respect to outwardly bending forces.

A geometry of the overlapping outside edge of the side wall and an embodiment of the primary locking lance may be adapted to one another in such a way that the outside edge of the side wall mechanically contacts the side edge of the primary locking lance in the unloaded state. In other words, the side wall of the contact box may be dimensioned and bent in the upwardly protruding area in such a way that its outside edge directly presses against the side edge of the primary locking lance, as long as an external force is not applied to the primary locking lance. In such an embodiment, the side wall only protrudes minimally further beyond the plane of the upper wall than the primary locking lance, so that the entire cross-sectional area of the contact is hardly enlarged. In this way, problems during the insertion of the contact into a contact chamber, for example, may be prevented from occurring as a result of an enlarged cross-sectional area of the contact.

In order to further simplify insertion of the contact into a contact chamber, inter alia, the at least one side wall, which, in the area adjoining the primary locking lance, protrudes beyond the plane of the upper wall of the contact box, may form an insertion chamfer having a wall height increasing opposite to an insertion direction of the contact into the contact chamber. The outside edge of the side wall may extend substantially in parallel to the primary locking lance, which protrudes diagonally outward.

In order to also simplify detachment of the contact from a contact chamber and in particular the guiding of the contact through a sealing mat situated behind the contact chamber, for example, the protruding side wall may form a removal chamfer, having a wall height decreasing opposite to the insertion direction of the contact into the contact chamber, in an area in the insertion direction behind the primary locking lance. When a contact is pulled out of a contact chamber opposite to the insertion direction, such a removal chamfer may prevent the primary locking lance or an area of the side wall pressing against this primary locking lance from hooking in the contact chamber or on the mat seal and possibly damaging it. The removal chamfer may be configured similarly to the insertion chamfer in such a way that it is nearly flush with the upper wall of the contact box at one end. The opposing end of the removal chamfer protrudes further above the plane of the upper wall and may merge directly and in a rounded way into the insertion chamfer, which is also formed by the side wall.

The primary locking lance and also the contact box and its side walls may be embodied in one piece. For example, all of these components of the contact may be formed from a single sheet metal plate by suitable stamping and bending.

It is to be noted that possible features and advantages of specific embodiments of the present invention are described herein partially with respect to a contact according to the present invention and partially with respect to a plug connection element according to the present invention. A person skilled in the art recognizes that the individual features may be combined or exchanged with one another in a suitable manner to be able to obtain further specific embodiments of the present invention and possible synergy effects in this way.

Specific embodiments of the present invention are described hereafter with reference to the appended drawings, neither the description nor the drawings being interpreted as restricting the present invention.

DETAILED DESCRIPTION

The figures are only schematic and are not to scale. Identical or identically acting features are provided with identical reference signs in the figures.

Figure 1:
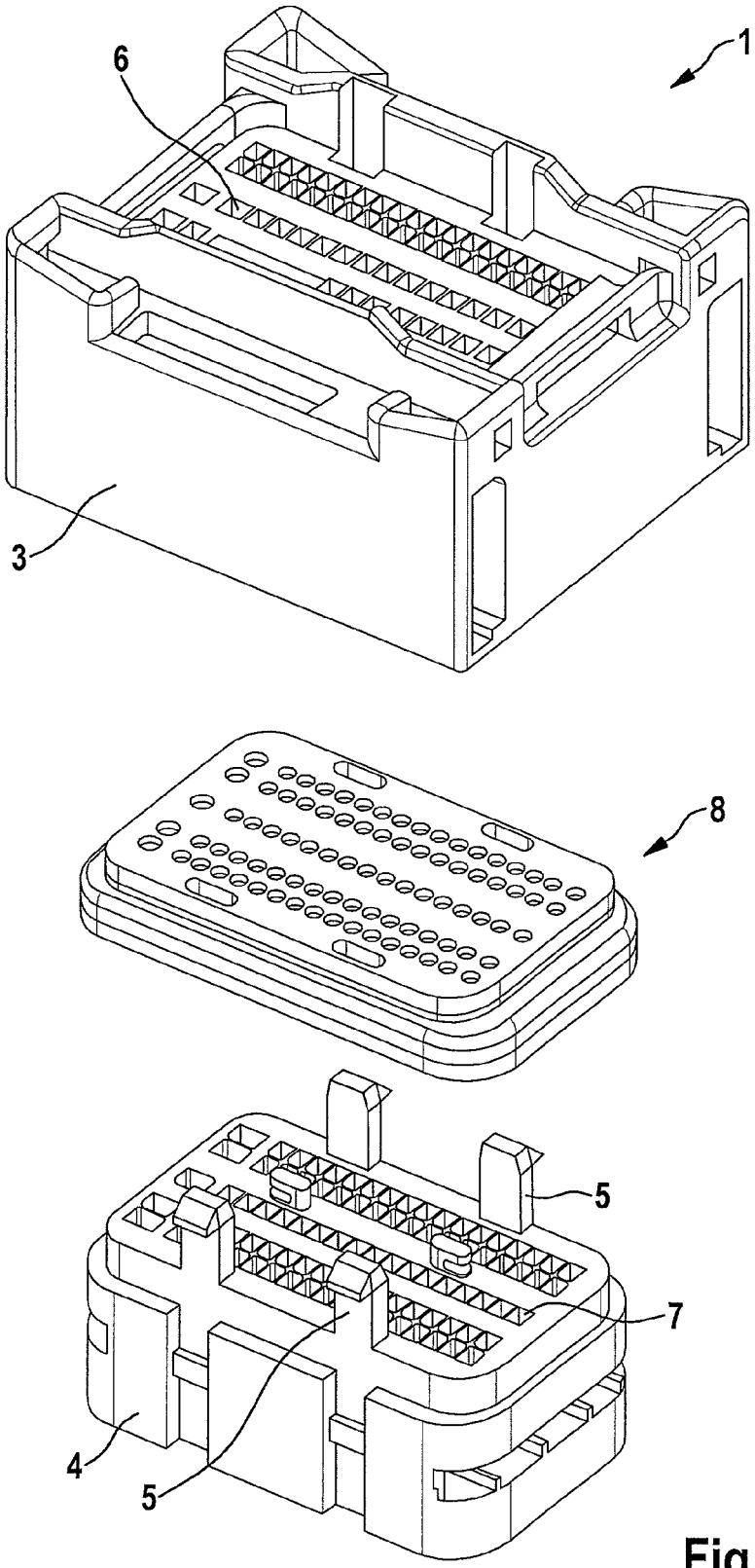
Fig. 1 Prior Art
FIG. 1 shows an exploded view of a plug connector.

FIG. 1 shows a plug 1, which, as a plug connection element, may be part of a plug connection to a counter plug. Plug 1 may be used, for example, for the mechanical and electrical interconnection of several cables or of a cable tree to a control unit of a motor vehicle.

Plug 1 has a housing upper part 3 and a housing lower part 4, which may be mechanically connected to one another via catch tabs 5. A mat seal 8 is situated between housing upper part 3 and housing lower part 4. Contact chambers 6, 7, through which cables and contacts fastened thereon (not shown in FIG. 1) may be inserted into plug 1 and fastened in a latching way therein, are provided both in housing upper part 3 and also in housing lower part 4.

Figure 2:
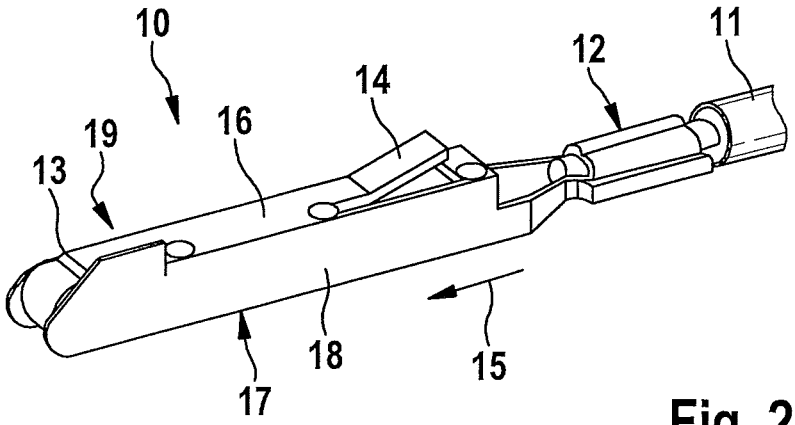
Fig. 2 Prior Art
FIG. 2 shows a perspective view of a contact having a primary locking lance.

FIG. 2 shows a contact 10, as may be inserted into a contact chamber 7 of a plug 1 and latched therein. A contact box 13, which is approximately cuboid, is provided on a front part of contact 10. The contact box has an upper wall 16, a lower wall 17, and two opposing side walls 18, 19. A cable 11 is fastened via a crimp area 12 on contact 10 at the rear end of contact 10.

On upper wall 16 of contact box 13, a primary locking lance 14 is provided, which protrudes diagonally to the rear opposite to an insertion direction 15 and projects beyond upper wall 16. This primary locking lance 14 is connected at one end in one piece to upper wall 16 of contact box 13 and may be displaced resiliently inward due to the elastic properties of the sheet metal forming the contact. Without the application of force, primary locking lance 14 protrudes outward. However, if contact 10 is inserted into a contact chamber 7, primary locking lance 14 is briefly pressed resiliently inward into the interior of contact box 13, in order to latch resiliently outward in a recess provided therein when an end position is reached.

Figure 3:
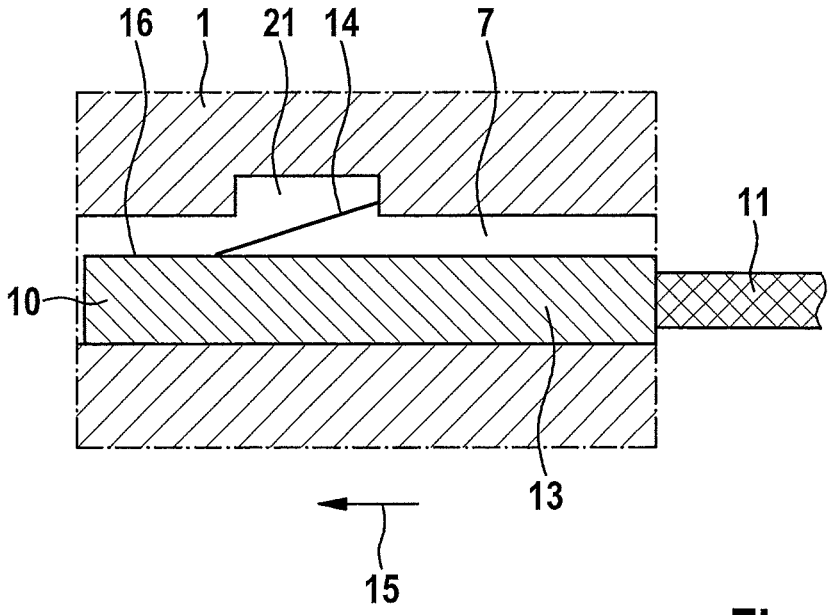
Fig. 3 Prior Art
FIG. 3 shows a contact locked in a contact chamber in a longitudinal section.

FIG. 3 shows in cross section how a contact 10 is latched in a contact chamber 7 of a plug 1. Primary locking lance 14, which protrudes from upper wall 16, engages in a recess 21 provided in contact chamber 7.

Figure 4:
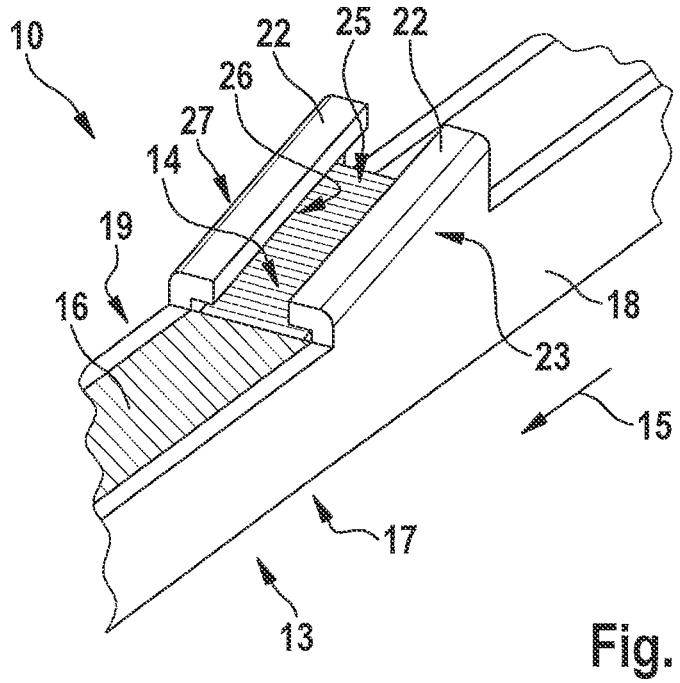
FIG. 4 shows a perspective partial view of a contact according to the present invention having an unloaded primary locking lance.
Figure 5:
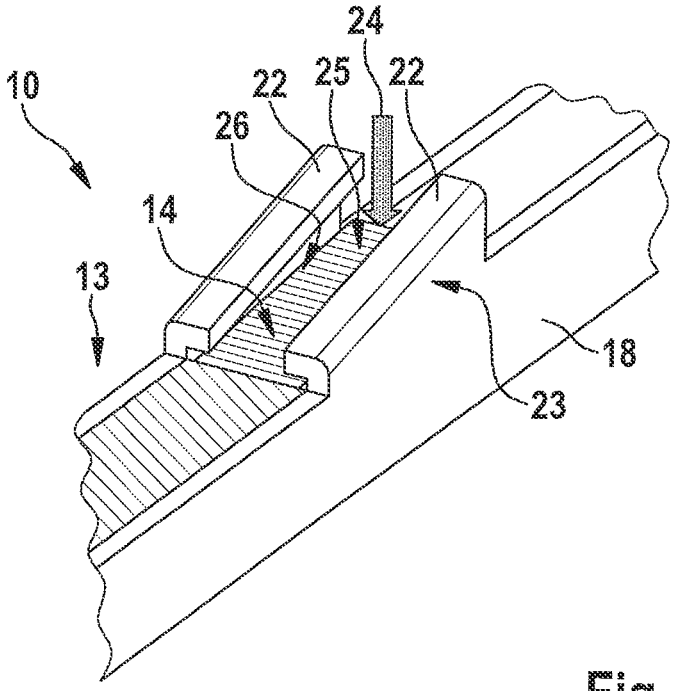
FIG. 5 shows a perspective partial view of a contact according to the present invention having a primary locking lance to which force is applied.
Figure 6:
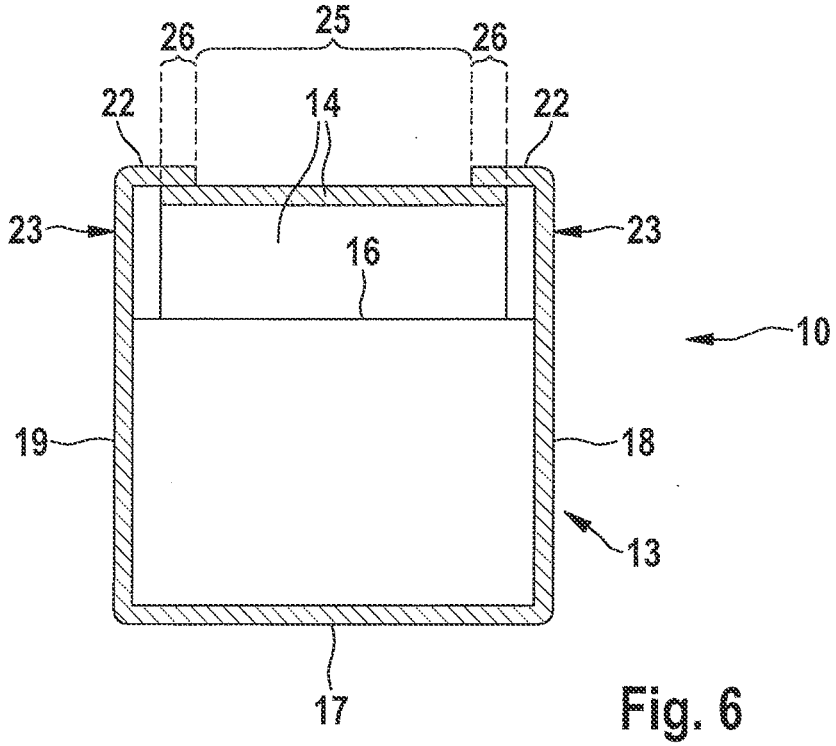
FIG. 6 shows a cross section through a primary locking lance according to the present invention.

FIGS. 4 and 5 show perspective partial views of a contact 10 according to one specific embodiment of the present invention. FIG. 6 shows a cross-sectional view through such a contact 10.

A contact box 13 has an upper wall 16, a lower wall 17, and two opposing side walls 18, 19. All walls 16 through 19 of contact box 13 are formed by suitable stamping and bending from a single sheet metal. A primary locking lance 14 protrudes diagonally outward from upper wall 16 opposite to insertion direction 15. Primary locking lance 14 is also formed by cutting free its edges from the same sheet metal as contact box 13 and merges at one end in one piece into upper wall 16, while the other end protrudes outward in a freestanding way.

In an area 23 laterally adjoining primary locking lance 14, side walls 18, 19 are designed by suitable stamping of the sheet metal used for the contact in such a way that they protrude outward beyond a plane of upper wall 16. A wall height of side walls 18, 19 continuously increases opposite to insertion direction 15, so that an insertion chamfer 27 is formed. Side wall 18 and also side wall 19 laterally adjoin primary locking lance 14 and protrude slightly beyond it, so that primary locking lance 14 is protected against forces acting from the side.

In addition, side walls 18, 19 are bent over downward toward primary locking lance 14 in area 23 on their outside edge 22 in each case, for example, at an angle of between 30° and 150°, which may be between 60° and 120°, and which may be between 90°±10°. Inwardly bent over edges 22 of side walls 18, 19 in area 23 therefore overlap primary locking lance 14 on its side edges 26. Side edges 26 of primary locking lance 14 are thus held in a form-locked manner by edges 22 of side walls 18, 19 in the event of an outwardly directed force acting on primary locking lance 14, so that primary locking lance 14 may not be bent excessively outward and plastically deformed in the process.

As shown in FIG. 4, side walls 18, 19 are configured in area 23 and in particular its outside edges 22 in such a way that edges 22 press directly against the outwardly oriented surface of primary locking lance 14, as long as it is not deflected toward contact box 13 by an inwardly directed force 24, as shown in FIG. 5.

At least one central area 25 of primary locking lance 14 in an area of primary locking lance 14 protruding farthest above upper wall 16 is not overlapped by one of edges 22 of side walls 18, 19, but rather is exposed. For example, during the insertion of contact 10 into a contact chamber 7, an appropriately adapted counter surface of contact chamber 7 may attack on this central area 25 and cause an inwardly directed force 24, which deflects primary locking lance 14 toward contact box 13, until contact 10 reaches an associated recess 21 and primary locking lance 14 is able to latch resiliently in this recess 21.

Figure 7:
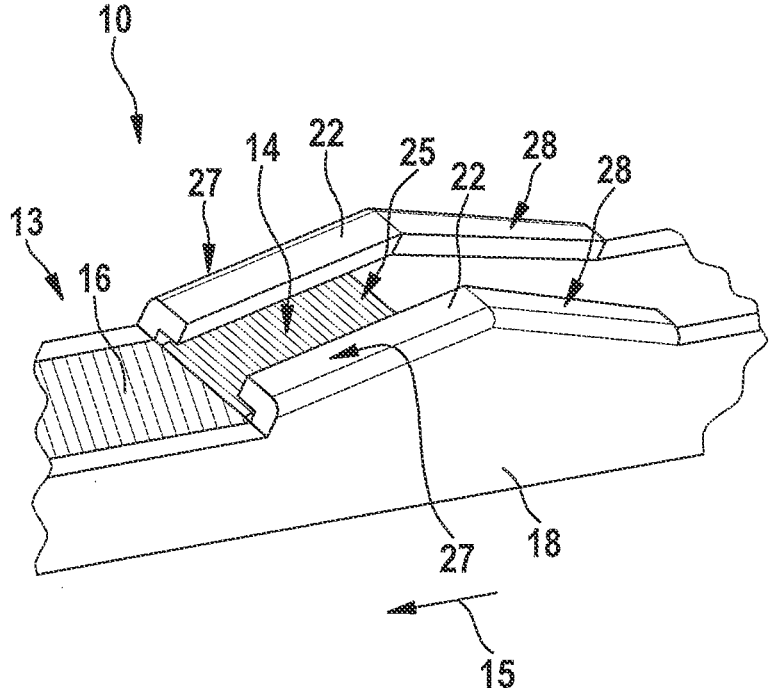
FIG. 7 shows a perspective partial view of another contact according to the present invention having a removal chamfer.

FIG. 7 shows another specific embodiment of a contact 10 according to the present invention in a perspective view. In addition to insertion chamfer 27, this contact 10 has a removal chamfer 28. In the area of this removal chamfer 28, side walls 18, 19 also protrude beyond the plane of upper wall 16, a wall height in this area, which is situated behind primary locking lance 14, continuously decreasing in a direction opposite to insertion direction 15 of the contact into the contact chamber.

While insertion chamfer 27 may be helpful during the assembly of a contact 10 in a contact chamber 7, removal chamfer 28 may be advantageous during detachment and withdrawal of contact 10 from such a contact chamber opposite to insertion direction 15. In both cases, particular chamfers 27, 28 may help to prevent damage to a mat seal 8 mounted upstream from contact chamber 7, for example.

What is claimed is:

1. A contact, which is provided for latching in a contact chamber of a plug connection element, comprising:

a contact box having an upper wall, a lower wall, and two opposing side walls; and a primary locking lance protruding resiliently diagonally outward from the upper wall;

wherein at least one of the side walls, in an area laterally adjoining the primary locking lance, protrudes outward beyond a plane of the upper wall, an outside edge of the at least one side wall overlapping a side edge of the primary locking lance so that it counteracts outward bending of the primary locking lance in a form-locked manner, wherein the overlapping outside edge of the side wall extends along the entire length of the outwardly protruding primary locking lance.

2. The contact of claim 1, wherein the outside edge of the at least one side wall does not overlap a central area of the primary locking lance, at least in an area of the primary locking lance protruding farthest above the upper wall.

3. The contact of claim 1, wherein the overlapping outside edge of the side wall mechanically contacts the side edge of the primary locking lance in the unloaded state.

4. The contact of claim 1, wherein the at least one of the side walls, in the area adjoining the primary locking lance, forms an insertion chamfer having a wall height increasing opposite to the insertion direction of the contact into the contact chamber such that the wall height increases at an angle less than 90 degrees.

5. The contact of claim 1, wherein the at least one of the side walls, in an area behind the primary locking lance in the insertion direction, forms a removal chamfer having a wall height decreasing opposite to the insertion direction of the contact into the contact chamber.

6. The contact of claim 1, wherein the primary locking lance is embodied in one piece with the contact box and its side walls.

7. The contact of claim 1, wherein both side walls, in an area laterally adjoining the primary locking lance, protrude outward beyond a plane of the upper wall, and outside edges of both side walls each overlap a side edge of the primary locking lance so that they counteract outward bending of the primary locking lance in a form-locked manner.

8. A plug connection element, comprising:

at least one contact chamber and at least one contact, which is latched in the contact chamber with the aid of a primary locking lance;

wherein the at least one contact, includes a contact box having an upper wall, a lower wall, and two opposing side walls, and a primary locking lance protruding resiliently diagonally outward from the upper wall, and wherein at least one of the side walls, in an area laterally adjoining the primary locking lance, protrudes outward beyond a plane of the upper wall, an outside edge of the at least one side wall overlapping a side edge of the primary locking lance along the entire length of the outwardly protruding primary locking lance so that it counteracts outward bending of the primary locking lance in a form-locked manner.

9. A contact, which is provided for latching in a contact chamber of a plug connection element, comprising:

a contact box having an upper wall, a lower wall, and two opposing side walls; and a primary locking lance protruding resiliently diagonally outward from the upper wall;

wherein at least one of the side walls, in an area laterally adjoining the primary locking lance, protrudes outward beyond a plane of the upper wall, an outside edge of the at least one side wall overlapping a side edge of the primary locking lance so that it counteracts outward bending of the primary locking lance in a form-locked manner, wherein the overlapping outside edge of the side wall mechanically contacts the side edge of the primary locking lance in the unloaded state.

10. A contact, which is provided for latching in a contact chamber of a plug connection element, comprising:

a contact box having an upper wall, a lower wall, and two opposing side walls; and a primary locking lance protruding resiliently diagonally outward from the upper wall;

wherein at least one of the side walls, in an area laterally adjoining the primary locking lance, protrudes outward beyond a plane of the upper wall, an outside edge of the at least one side wall overlapping a side edge of the primary locking lance so that it counteracts outward bending of the primary locking lance in a form-locked manner, wherein the at least one of the side walls, in the area adjoining the primary locking lance, forms an insertion chamfer having a wall height increasing opposite to the insertion direction of the contact into the contact chamber such that the wall height increases at an angle less than 90 degrees.

11. A contact, which is provided for latching in a contact chamber of a plug connection element, comprising:

a contact box having an upper wall, a lower wall, and two opposing side walls; and a primary locking lance protruding resiliently diagonally outward from the upper wall;

wherein at least one of the side walls, in an area laterally adjoining the primary locking lance, protrudes outward beyond a plane of the upper wall, an outside edge of the at least one side wall overlapping a side edge of the primary locking lance so that it counteracts outward bending of the primary locking lance in a form-locked manner, wherein the at least one of the side walls, in an area behind the primary locking lance in the insertion direction, forms a removal chamfer having a wall height decreasing opposite to the insertion direction of the contact into the contact chamber.

* * * * *